US010589148B1

(12) United States Patent
Lage

(10) Patent No.: US 10,589,148 B1
(45) Date of Patent: Mar. 17, 2020

(54) INCLINABLE RECUMBENT EXERCISE DEVICE

(71) Applicant: Robert James Lage, Fort Lauderdale, FL (US)

(72) Inventor: Robert James Lage, Fort Lauderdale, FL (US)

( * ) Notice: Subject to any disclaimer, the term of this patent is extended or adjusted under 35 U.S.C. 154(b) by 129 days.

(21) Appl. No.: 15/911,124

(22) Filed: Mar. 4, 2018

(51) Int. Cl.
*A63B 22/08* (2006.01)
*A63B 22/06* (2006.01)
*A63B 22/00* (2006.01)

(52) U.S. Cl.
CPC ..... *A63B 22/0605* (2013.01); *A63B 22/0046* (2013.01); *A63B 2022/0652* (2013.01); *A63B 2225/09* (2013.01)

(58) Field of Classification Search
CPC ..... A63B 22/0023; A63B 22/0605; A63B 2208/025; A63B 2022/0652; Y10S 482/908
See application file for complete search history.

(56) References Cited

U.S. PATENT DOCUMENTS 3,189,344 A * 6/1965 Swarts ..... A63B 22/0007 482/57
4,411,443 A 10/1983 Pollard
4,538,804 A * 9/1985 Zibell ..... A63B 21/015 482/57
5,178,593 A * 1/1993 Roberts ..... A63B 23/03516 482/56
5,601,515 A * 2/1997 Matsumoto ..... A63B 22/0605 482/57
6,270,446 B1 8/2001 Abelbeck et al.
6,413,192 B2 7/2002 Abelbeck
6,500,099 B1 12/2002 Eschenbach
6,547,701 B1 4/2003 Eschenbach
6,645,129 B2 11/2003 Eschenbach
8,480,548 B2 * 7/2013 Gerschefske ..... A63B 5/00 482/96
8,696,526 B1 4/2014 Dew
(Continued)

FOREIGN PATENT DOCUMENTS

DE 19925903 A1 * 12/2000
EP 1955735 A1 * 8/2008 ..... A63B 5/11
GB 2346333 A * 2/1999

OTHER PUBLICATIONS

Unknown Author, "Recumbent Bikes | Bacchetta Bikes," Jan. 20, 2018 or earlier, https://www.bacchettabikes.com/recumbent-bikes/.
(Continued)

*Primary Examiner* — Joshua T Kennedy
(74) *Attorney, Agent, or Firm* — George F. Wallace

(57) ABSTRACT

An inclinable recumbent exercise device includes a rigid support base having front and rear portions, and extending along a plane from the front portion to the rear portion; a seat engaged with the base at the rear portion; a kinetic element engaged with the support base, and having first and second moveable leg engagement elements; and a fulcrum element positioned below the base. The base is pivotal about the fulcrum element from a first base position, in which the kinetic element is at an initial position, to a second base position, in which the kinetic element is at a subsequent position above the initial position and the seat.

12 Claims, 3 Drawing Sheets

(56) References Cited

U.S. PATENT DOCUMENTS

| | | | | |
|---|---|---|---|---|
| 8,721,509 | B1 * | 5/2014 | Berdut-Teruel ..... | A63B 21/068<br>482/121 |
| 8,821,354 | B1 | 9/2014 | Tabahi | |
| 9,114,278 | B1 | 8/2015 | Sigel | |
| 2013/0196828 | A1 | 8/2013 | Kaye | |

OTHER PUBLICATIONS

Unknown Author, "Sensitrac ~ Bikes, Parts and accessories," Jan. 21, 2018 or earlier, http://www.sensitrac.com/recumbent-bikes/recumbent-bike-weight-loss-success-stories-best-recumbent-road-bikes-2015-recumbent-bike-benefits-2-wheel-recumbent-road-bike/.

Unknown Author, "ProForm LE Tour de France Exercise Bike Home Gym Cycling—Brand New / Fast Ship," , Jan. 27, 2018 or earlier, https://www.ebay.com/itm/ProForm-LE-Tour-de-France-Exercise-Bike-Home-Gym-Cycling-BRAND-NEW-FAST-SHIP/152949045399?epid=1750300027&hash=item239c793897:g:X8AAAOSwpVpakiVH.

* cited by examiner

FIG. 4
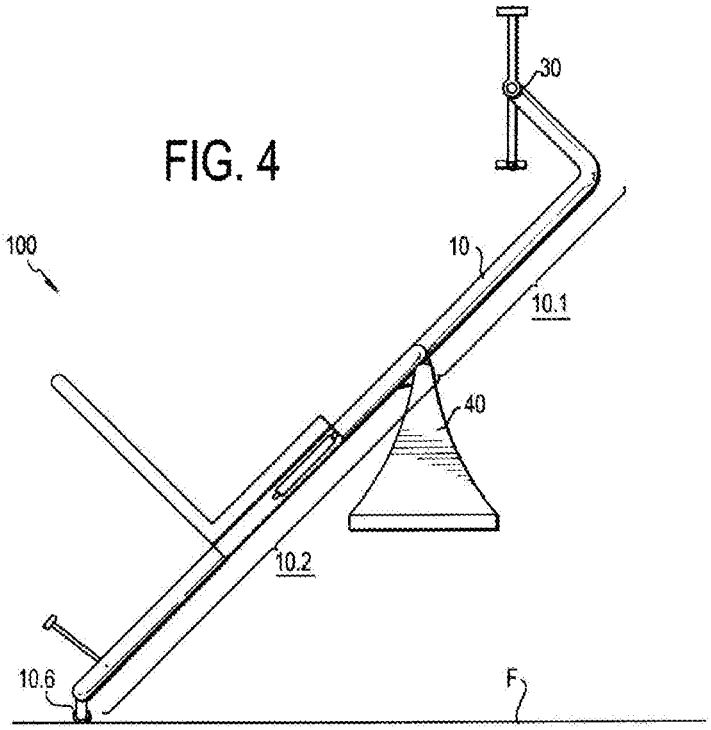
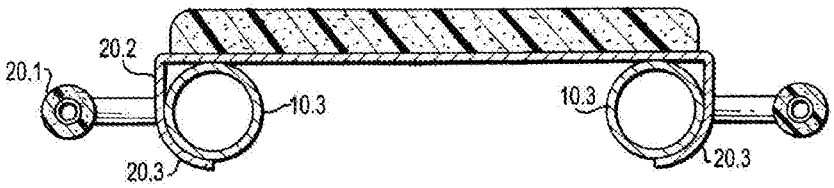
FIG. 5
FIG. 6
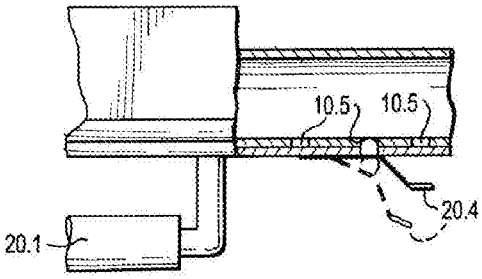

FIG. 7
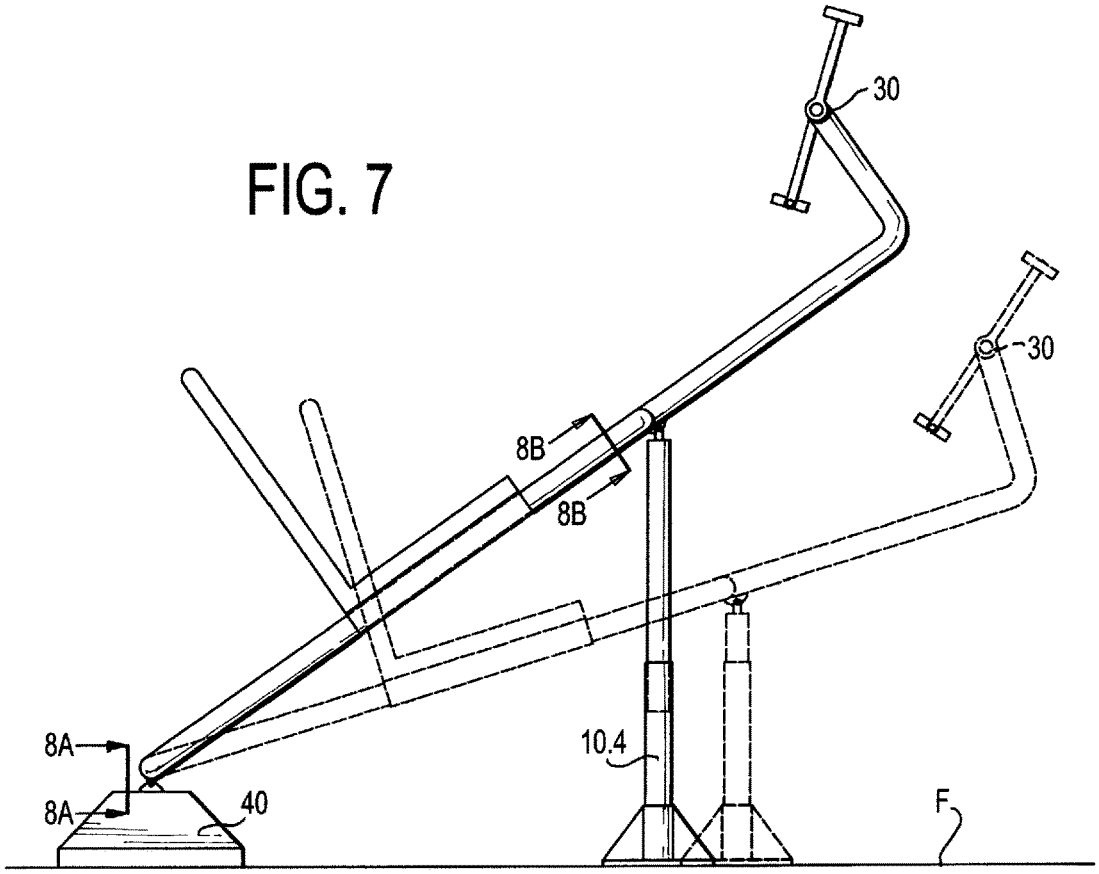
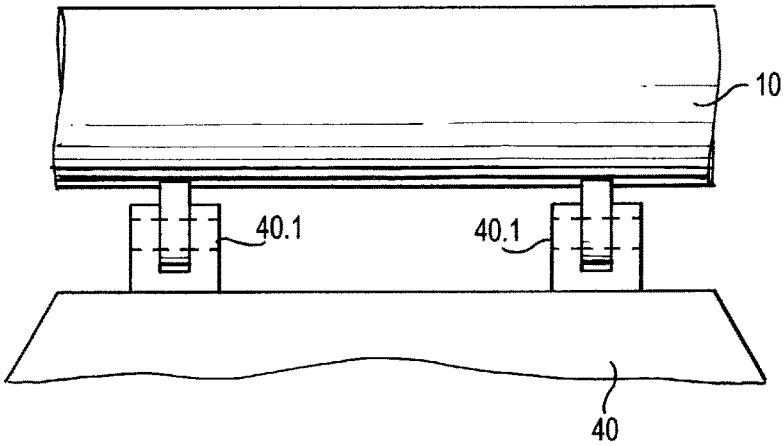
FIG. 8A
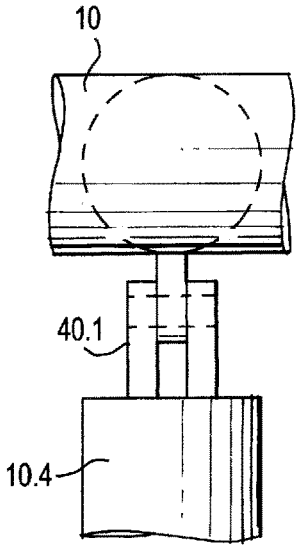
FIG. 8B

INCLINABLE RECUMBENT EXERCISE DEVICE

FIELD OF INVENTION

The present invention relates to exercise devices, and more particularly, to recumbent exercise devices.

BACKGROUND OF THE INVENTION

Exercise devices can be used for the improvement and/or maintenance of a user's physical fitness and/or conditioning, as well as for rehabilitative purposes subsequent to an injury.

Recumbent exercise devices provide a seating element and kinetic element that are generally positioned along a plane generally parallel to the ground. Accordingly, while in a seated position, a user's legs engage the kinetic element such that the user's legs are positioned along such a plane.

SUMMARY OF THE INVENTION

It is an object of the present invention to provide an inclinable recumbent exercise device.

It is another object of the present invention to provide an inclinable recumbent exercise device, and a method of using the same, that allows a user to engage in physical exercise.

In an exemplary embodiment of the present invention, an inclinable recumbent exercise device can include a rigid support base, a seat, a kinetic element, and a fulcrum element.

In an exemplary aspect of the present invention, a rigid support base can include front and rear portions, and can extend along a plane from the front portion to the rear portion.

In another exemplary aspect of the present invention, a seat can be engaged with the base at the rear portion.

In a further exemplary aspect of the present invention, a kinetic element can be engaged with the support base, and can include first and second moveable leg engagement elements.

In still another exemplary aspect of the present invention, a fulcrum element can be positioned below the base.

In still yet a further exemplary aspect of the present invention, the base can be pivotal about the fulcrum element from a first base position, in which the kinetic element is at an initial position, to a second base position, in which the kinetic element is at a subsequent position above the initial position and the seat.

In a further exemplary aspect, the leg engagement elements can be configured to respectively engage at least one of a respective one of a user's feet and a user's legs.

In another exemplary aspect, the fulcrum element can be positioned at or between the front and rear portions.

Any combination of one of more of the following are additional optional exemplary aspects of the present invention:

- a seat can be moveably engaged with the base and moveable, along the plane, and from a first seat position to a second seat position;
- a device can further include at least one of a front leg and a rear leg, with a front leg being moveably engaged with the front portion, and being moveable from a first front leg position and a second front leg position below the first front leg position; and with a rear leg being moveably engaged with the rear portion, and being moveable between a first rear leg position and a second rear leg position below the first rear leg position; and
- a device can further include at least one roller element connected to the device and configured to roll along a floor so as to facilitate movement of the device.

In another exemplary embodiment of the present invention, a method of adjusting any embodiment of an inclinable recumbent exercise device enabled herein can include the steps of: pivoting the base about the fulcrum element from a first base position, in which the kinetic element is at an initial position, to a second base position, in which the kinetic element is at a subsequent position above the initial position and the seat; optionally, moving the seat along the plane from a first seat position to a second seat position; optionally, positioning a front leg from a first front leg position to a second front leg position below the first front leg position; and optionally, relocating a rear leg from a first rear leg position to a second rear leg position below the first rear leg position.

These and other exemplary aspects and embodiments of the present invention are further described herein.

BRIEF DESCRIPTION OF THE DRAWINGS

FIG. 4 illustrates an exemplary inclinable recumbent exercise device in a moveable orientation with a front portion raised to allow a roller to engage a floor.

FIG. 5 illustrates an exemplary seat having a seat frame moveable along base rails.

FIG. 6 illustrates an exemplary seat lock 20.4 selectably positionable within a base notch 10.5.

FIG. 7 illustrates an exemplary inclinable recumbent exercise device having a telescoping leg.

FIG. 8*a* illustrates an exemplary fulcrum element moveable engaged with a base via at least one fulcrum hinge.

FIG. 8*b* illustrates an exemplary telescoping leg movably engaged with a base.

DETAILED DESCRIPTION

This disclosure includes a plurality of embodiments, with a plurality of elements and aspects, and such elements and aspects need not necessarily be interpreted as being conjunctively required by one or more embodiments of the present invention. Rather, all combinations of the one or more elements and/or aspects can enable a separate embodiment of the present invention, which may be claimed with particularity in this or any one or more future filed Non-Provisional Patent Applications. Moreover, any particular materials, structures, and/or sizes disclosed herein, whether expressly or implicitly, are to be construed strictly as illustrative and enabling, and not necessarily limiting. Therefore, it is expressly set forth that such materials, structures, and/or sizes independently or in any combination thereof, are merely illustratively representative of one or more embodiments of the present invention and are not to be construed as necessary in a strict sense.

Further, to the extent the same element or aspect is defined differently within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent herefrom. However, it is expressly set forth that these benefits are not intended as exclusive. Therefore, any explicit, implicit, or apparent benefit from any embodiment enabled herein is expressly deemed applicable to the present invention.

According to the present invention, any portion of an inclinable recumbent exercise device can be formed and/or provided, in whole or in part, from any one or more materials or combinations of materials, such as one or more of plastic, rubber, wood, metal, crystalline material, or any other man-made or naturally occurring material, for example and not in limitation, insofar as the same is functionally consistent with the invention as described.

The present invention provides an inclinable recumbent exercise device that includes a pivoting feature that allows a kinetic element to be movable to a raised position and/or a seat to be movable to a lowered position, such that the kinetic element can be positioned above the heart of a seated user. In an exemplary embodiment, a kinetic element and seat can move, as above, in a simultaneous manner via the pivoting feature.

Figure 1:
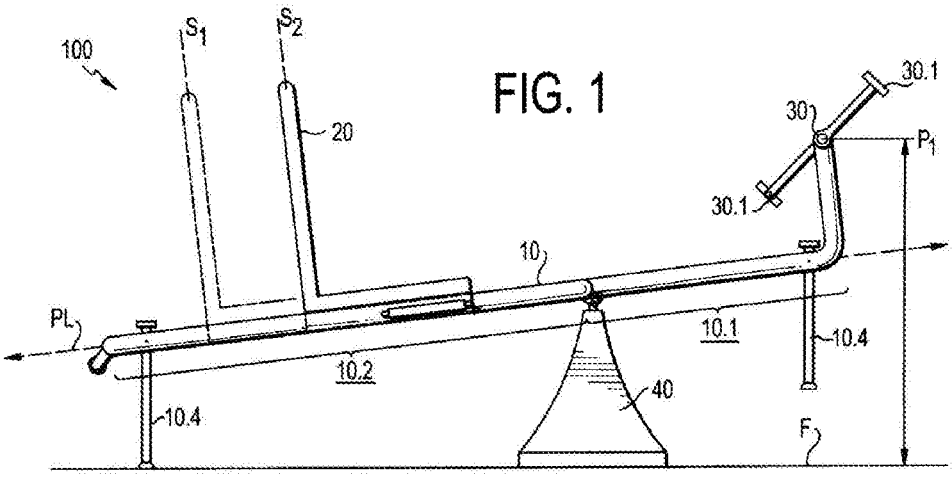
FIG. 1 illustrates an exemplary inclinable recumbent exercise device having a rigid support base 10, a seat 20, a kinetic element 30, and a fulcrum element 40, and with the kinetic element in an initial position.

FIG. 1 illustrates an exemplary inclinable recumbent exercise device 100, which can include a rigid support base 10, a seat 20, a kinetic element 30, and a fulcrum element 40.

In an exemplary aspect of the present invention, support base 10 can include front and rear portions 10.1, 10.2, and can generally extend along a plane PL from the front portion to the rear portion. Further, base 10 can be provided with an overall rigid construction, which can be effectuated via selection of any one or more materials and/or shapes to render the same sufficiently rigid to function given anticipated stresses and forces arising from use of device 100 as described. In an exemplary configuration, as illustrated in FIG. 5, base 10 can include a pair of parallel base rails 10.3; however, as noted above, the base can be provided in any functionally consistent shape or shapes desired.

In another exemplary aspect, seat 20 can be engaged with base 10 at rear portion 10.2 via any one or more of a bolt, nut, screw, clamp, weld, slidable frame, or other known or apparent structural attachment or engagement. According to the present invention, seat 20 can be provided in any functional consistent structural configuration, with or without a back portion, that is sufficient to allow a user (not shown) to sit thereon and interact with kinetic element 30.

In optional exemplary aspects, as illustrated in FIGS. 5 and 6, seat 20 can be provided with at least one of handles 20.1 to assist a seated user (not shown) whilst using device 100, and a seat frame 20.2 having inwardly angled terminal portions 20.3, which can provide moveable engagement of seat 20 with base rails 10.3 of base 10. As illustrated in FIG. 1, seat 20 can be movable along plane P between a first position $S_1$ and second position $S_2$ closer to leg engagement elements 30.1. As illustratively shown in FIG. 6, seat element 20 can include a seat lock 20.4 selectably positionable within a base notch 10.5 to lock the seat in a desired position.

Referring again to FIG. 1, in a further exemplary aspect, as illustrated, kinetic element 30 can be engaged with base 10 at rear portion 10.2, and can include first and second moveable leg engagement elements 30.1. In another exemplary aspect, kinetic element 30 can provide a user with any one or more types of motion, such as rotary, linear, reciprocating, oscillating, etc. along any one or more fixed or dynamic planes and/or arcs. Notably, kinetic element 30 can provide fixed and/or variably levels of resistance to modify exercise intensity realized by a user. For example and not in limitation, kinetic element 30 can provide such resistance through any one or more known or apparent mechanism or mechanisms, such as magnetic-, friction-, hydraulic-, pressure-, and other kinetic-based mechanisms.

As illustratively shown in FIG. 1, leg engagement elements 30.1 can be provided as pedals, which can engage a user's legs at their feet (not shown); however, the present invention contemplates any type leg engagement elements that functionally engage any one or more portions of a user's legs in effectuating a motion-based exercise, such as at a user's chin, calf, or thigh, for example and not in limitation.

Also according to the present invention, as illustrated in FIG. 1, fulcrum element 40 can be provided at a position below base 10 and at or between front and rear portions 10.1, 10.2. It should be noted that fulcrum element 40 can be provided with any desired shape and/or size, and can include any desired structural aspects (such as a hinge, for example and not in limitation), insofar as the same in functionally consistent with the present invention.

Figure 2:
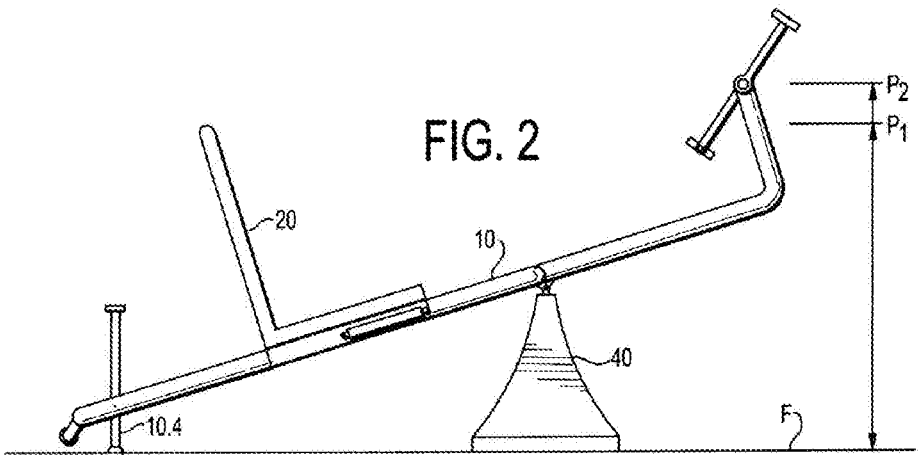
FIG. 2 illustrates an exemplary inclinable recumbent exercise device with a base pivoted about a fulcrum to position a kinetic element in a subsequent position.
Figure 3:
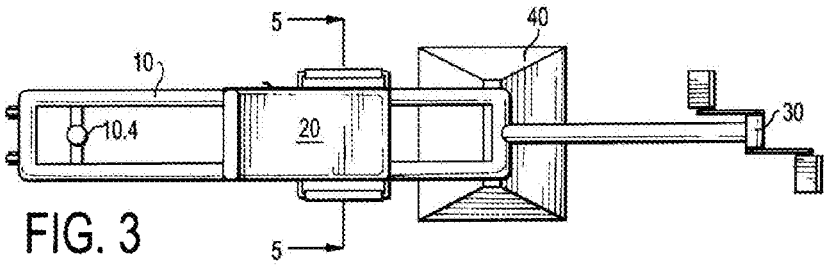
FIG. 3 illustrates, from a top-down view, an exemplary inclinable recumbent exercise device.

In another an exemplary aspect, as illustratively shown in FIGS. 1 and 2, base 10 can be pivotal about fulcrum element 40 from a first base position, in which kinetic element 30 is at an initial position $P_1$, to a second base position, in which the kinetic element is at a subsequent position $P_2$ above the initial position and seat 20. For example and not in limitation, as illustrated in FIG. 8*a*, fulcrum element 40 can include at least one fulcrum hinge 40.1, which can effectuate pivotal engagement of base 10 about the fulcrum element. In an optional exemplary aspect, base 10 can be selectively fixed relative to fulcrum element 40 to maintain a desired inclination of the base. For example and not in limitation, such fixation can be effectuated via one or more of the at least one fulcrum hinge 40.1 being locked via any one or more desired structures, such as a pin-hole combination, screw, etc., for example and not in limitation.

According to the present invention, an inclinable recumbent exercise device 100 can optionally include at least one leg 10.4, with each leg moveably engaged with base 10, and oriented to abut a floor, other structure below device 100, or a portion of the device. In an exemplary aspect, such a leg 10.4 can be moveably engaged at any portion of base 10. As illustrated in FIGS. 1, 2, and 7, in another exemplary aspect, such a leg 10.4 can define a lowest position of base 10 by simultaneously engaging the base 10 and floor F or other structure or part of exercise device 100.

According to the present invention, such a leg 10.4 can be provided with any one or more desired shapes, sizes, and/or configurations insofar as functionally compatible. Further, leg 10.4 can be provided with an elongated configuration (illustratively shown in FIG. 1) and/or a telescoping configuration (illustratively shown in FIGS. 7 and 8*b*), respectively.

In another exemplary aspect, leg 10.4 can be moveably engaged with base 10, via any desired structure(s), such as via a threads-threaded sleeve combination, a hole-pin combination, a screw, etc., to allow the leg to be moveable from a first leg position to a second leg position below the first leg position, and maintainable at the second leg position.

As illustrated in FIG. 4, in another optional exemplary aspect, device 100 can further include at least one roller 10.6 engaged with a portion of device 100, such as with base 10 for example and not in limitation, and configured to roll along a floor F to facilitate movement of the device across the floor. For example and not in limitation, roller 10.6 can be engaged with rear portion 10.2, such that front portion 10.1 can be raised by a user (not shown) so that the roller can abut floor F and device 100 can be moved along the floor.

In another exemplary aspect of the present invention, a method of adjusting any embodiment of an inclinable recumbent exercise device enable herein can include pivoting the base about the fulcrum element from a first base position, in which the kinetic element is at an initial position $P_1$ (as illustrated in FIG. 1), to a second base position $P_2$, in which the kinetic element is at a subsequent position above the initial position and the seat (as illustrated in FIG. 2).

Therefore, it will be apparent to one of ordinary skill in the art that the manner of making and using the claimed invention has been adequately disclosed in the above-written description of the exemplary embodiments and aspects.

It should be understood, however, that the invention is not necessarily limited to the specific embodiments, aspects, arrangement, and components shown and described above, but may be susceptible to numerous variations within the scope of the invention. For example, while the present invention is illustratively shown having a kinetic element with orbital kinetic motion, a kinetic element with any form of motion can be used, including rotary, linear, reciprocating, oscillating, etc.

Therefore, the specification and drawings are to be regarded in an illustrative and enabling, rather than a restrictive, sense.

Accordingly, it will be understood that the above description of the embodiments of the present invention are susceptible to various modifications, changes, and adaptations, and the same are intended to be comprehended within the meaning and range of equivalents of the appended claims.

I claim:

1. An inclinable recumbent exercise device, comprising:

a rigid support base having front and rear portions, said base extending along a plane from the front portion to the rear portion;

a seat engaged with said base at the rear portion;

a kinetic element engaged with said base at the front portion, said kinetic element having first and second moveable leg engagement elements;

a leg moveably engaged with said base at one of the front and rear portions; and a fulcrum element positioned below said base and between the front and rear portions, such that the front and rear portions pivot about said fulcrum element to move said kinetic element from a first distance from a floor to a second distance greater than the first distance, and the front portion being positioned above the rear portion relative to the floor;

wherein said base is pivotal about said fulcrum element from a first base position, in which said kinetic element is at an initial position, to a second base position, in which said kinetic element is at a subsequent position above the initial position and said seat.

2. The device of claim 1, wherein the first and second leg engagement elements are configured to respectively engage a respective one of a user's feet.

3. The device of claim 1, wherein the first and second leg engagement elements are configured to respectively engage a respective one of a user's legs.

4. The device of claim 1, wherein said seat is moveably engaged with said base and moveable, along the plane, and from a first seat position to a second seat position closer to the leg engagement elements.

5. The device of claim 1, further comprising another leg moveably engaged with the other of the front and rear portion.

6. The device of claim 1, further comprising at least one roller engaged with the device and configured to roll along a floor to facilitate movement of the device across the floor.

7. A method of adjusting an inclinable recumbent exercise device comprising a rigid support base having front and rear portions, the base extending along a plane from the front portion to the rear portion, a seat engaged with the base at the rear portion, a leg moveably engaged with said base at one of the front and rear portions, a kinetic element engaged with the base at the front portion, the kinetic element having first and second moveable leg engagement elements, and a fulcrum element positioned below the base and between the front and rear portions, such that the front and rear portions pivot about the fulcrum element to move the kinetic element from a first distance from a floor to a second distance greater than the first distance, with the front portion being positioned above the rear portion relative to the floor, said method comprising a step of:

pivoting the base about the fulcrum element from a first base position, in which the kinetic element is at an initial position, to a second base position, in which the kinetic element is at a subsequent position above the initial position and the seat.

8. The method of claim 7, wherein the seat is moveably engaged with the base, and the method further comprises the step of moving the seat along the plane from a first seat position to a second seat position.

9. The method of claim 7, wherein the method further comprises the step of repositioning the leg from a first leg position to a second leg position below the first leg position.

10. The method of claim 9, wherein the method further comprises the step of positioning the other leg from a first other leg position to a second other leg position below the first other leg position.

11. The method of claim 7, wherein the device further comprises at least one roller connected to the device and configured to roll along a floor to facilitate movement of the device.

12. The method of claim 11, wherein the seat is moveably engaged with the base, and the method further comprises the step of moving the seat along the plane from a first seat position to a second seat position.

* * * * *